US006686544B2

(12) United States Patent
Inoue

(10) Patent No.: US 6,686,544 B2
(45) Date of Patent: Feb. 3, 2004

(54) WIRING MATERIAL AND METHOD FOR MANUFACTURING THE SAME

(75) Inventor: Takuya Inoue, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/127,660

(22) Filed: Apr. 23, 2002

(65) Prior Publication Data

US 2002/0170738 A1 Nov. 21, 2002

(30) Foreign Application Priority Data

Apr. 25, 2001 (JP) ..... 2001-128148
May 9, 2001 (JP) ..... 2001-138862

(51) Int. Cl.[7] ..... H01B 7/08
(52) U.S. Cl. ..... 174/117 F
(58) Field of Search ..... 174/117 F, 117 FF, 174/88 R

(56) References Cited

U.S. PATENT DOCUMENTS 3,715,457 A * 2/1973 Teagno et al. ..... 174/88 R
4,551,579 A * 11/1985 Takasaki ..... 174/88 R
4,578,529 A * 3/1986 Look ..... 174/117 FF
4,870,227 A * 9/1989 Saen et al. ..... 174/117 FF
5,356,308 A * 10/1994 Toba et al. ..... 439/495
5,509,204 A * 4/1996 Sadigh-Behzadi ..... 29/883
6,016,253 A * 1/2000 Seitz et al. ..... 361/735

FOREIGN PATENT DOCUMENTS

JP A 3-4464 1/1991
JP A 3-4465 1/1991

* cited by examiner

*Primary Examiner*—Chau N. Nguyen
(74) *Attorney, Agent, or Firm*—Oliff & Berridge, PLC

(57) ABSTRACT

The wiring material is manufactured in such a manner that a plurality of flat cables is superimposed on top of one another. In the end portions of the conductors of the respective flat cables, there are formed terminal fixing portions. The terminal fixing portions are formed by removing an insulating material disposed on one-side outer surfaces of the end portions of the flat cables, forming small-width portions smaller in the conductor width than the remaining portions of the flat cables in a part of the insulating material removed areas; and, folding back the flat cables in the small-width portions and superimposing the conductors on top of one another. Due to proper superimposition of these flat cables, the respective terminal fixing portions can be arranged sequentially in the width direction of the flat cables at a prescribed pitch.

15 Claims, 15 Drawing Sheets

(c)

WIRING MATERIAL AND METHOD FOR MANUFACTURING THE SAME

BACKGROUND OF THE INVENTION

1. Field of the Invention

This invention relates to a wiring material which is, for example, used in a harness for a car and a method for manufacturing the same.

2. Background Art

Generally, as a flexible wiring material for use in a vehicle, there is known a flat cable composed of a plurality of flat conductors (for example, rectangular conductors) arranged in the width direction thereof and covered by an insulating-material. Such flat cable has various advantages: for example, it is small in thickness and excellent in flexibility as well as, because it can be curved, the direction thereof can be changed freely.

As means for securing the current capacity of the rectangular conductor, there are available several means; for example, means for increasing the width of the rectangular conductor, means for increasing the number of rectangular conductors and making a circuit using a plurality of rectangular conductors, and means for increasing the thickness of the rectangular conductor to thereby increase the section area of the rectangular conductor.

By the way, in the case of a flat cable, a terminal is connected to the end portion of the flat cable and the thus connected terminal is fitted with a connector to thereby form a wiring material; and, the thus-formed wiring material is connected to an apparatus such as a motor. As the connector to be fitted with the terminal, it is preferred to use an existing connector and, therefore, in the flat cable, the arrangement pitch and width of the rectangular conductors must be designed so as to conform to an existing terminal.

In case where the width of the rectangular conductor is increased in order to secure the required current capacity, the design of the connector must be changed greatly so as to correspond to the thus increased width of the rectangular conductor. In this case, however, the flat cable including the width-increased rectangular conductor cannot be connected to the existing terminal. Also, in case where, in order to secure the current capacity of the rectangular conductors, the number of rectangular conductors is increased and a plurality of rectangular conductors are allotted to one circuit, the widths of the connector and flat cable must be increased, which makes it necessary to change the shape of the existing connector. Further, in case where, in order to secure the current capacity of the rectangular conductor, the thickness of rectangular conductors is increased, the thickness of the flat cable is increased accordingly to thereby lower the flexibility of the flat cable, with the result that the flat cable is not be able to fulfill its original function.

As a method for solving the above problems, there is known a method which is disclosed in Japanese Patent Application, First Publication Nos. Hei.3-4464 and Hei.3-4465.

That is, in the above-cited publication, there is disclosed a method in which, as shown in FIG. 16, the width of a flat cable is increased to thereby increase the width of rectangular conductors included in the flat cable so as to secure the required current capacity of the flat cable; and, the leading end portion of the flat cable is drawn or narrowed so as to conform to the pitch width of the cavity of an existing connector, and the flat cable is then connected to the existing connector. However, in case where the end portion of the flat cable is drawn in this manner, there arise not only a problem that the current capacity of the flat cable is limited and thus a desired current is not allowed to flow, but also a problem that the resistance of the drawn portion increases and thus heat is generated in the drawn portion. Also, in case where such drawn portion is formed in the flat cable, the dimension of the flat cable cannot be adjusted at an arbitrary position, which makes it impossible to produce the flat cable continuously.

Moreover, since the flat cable disclosed in the above-cited publication is quite irregular in the shape of the end portion thereof, continuous manufacture of the flat cable is substantially impossible: that is, the flat cable is poor not only in the mass productivity but also in the yield rate.

SUMMARY OF THE INVENTION

The present invention aims at eliminating the drawbacks found in the above-mentioned wiring materials. Accordingly, it is an object of the invention to provide a wiring material in which not only the widths of the main body portions of the respective conductors thereof can be expanded to thereby increase the current capacity thereof but also, without reducing the mass productivity and yield rate thereof, the terminal end portions of the respective conductors can be matched to terminals to be connected to the respective conductors, and a method for manufacturing such wiring material.

It is another object of the invention to provide a wiring material structured such that not only flat cables thereof can be formed so as to conform to an existing connector while securing the required current capacity thereof but also the flexibility of the flat cables are not degraded.

In attaining the above object, according to a first aspect of the invention, there is provided a wiring material comprising a plurality of flat cables, each of the plurality of flat cables including a plurality of conductors arranged in the width direction thereof and an insulating body for covering the outer surfaces of the respective conductors, wherein the respective conductors of the respective flat cables include in the end portions thereof terminal fixing portions formed smaller in width than the main body portions of their respective conductors for fixation of connecting terminals thereto, and the plurality of flat cables are superimposed on top of one another in the thickness direction thereof in such a manner that the terminal fixing portions are shifted in position from one another in the width direction thereof and are thereby arranged at the same pitch as the arrangement pitch of the connecting terminals.

According to the present structure, simply by superimposing a plurality of flat cables on top of one another, each flat cable including terminal fixing portions formed in the end portions of the respective conductors, the terminal fixing portions can be arranged in the width direction thereof at the same pitch as the connecting terminal arrangement pitch. Therefore, while not only expanding the widths of the main body portions of the respective conductors but also preventing the end portions of the conductors of the respective flat cables from being formed in irregular shapes, the end portions of the present conductors and their respective connecting terminals can be matched together.

Here, the concrete formation positions of the terminal fixing portions in the respective flat cables are not limitative but the flat cables may be superimposed on top of one another in such a manner that the terminal fixing portions can be finally arranged at a given terminal arrangement pitch. For example, there can be employed a structure in which the flat cables are set equal to one another in the number and arrangement pitch of the conductors and, between the flat cables, the formation positions of the terminal fixing portions of the respective conductors are shifted from one another in the width direction thereof by the above-mentioned connecting terminal arrangement pitch. That is, in this case, by employing flat cables which are equivalent to one another in the basic arrangement thereof, the mass productivity thereof can be enhanced further and the terminal fixing portions can be arranged at a given arrangement pitch without shifting the flat cable superimposed positions in the width direction thereof from one another.

Therefore, by fixing the connecting terminals to the their respective terminal fixing portions of the present wiring material, there can be easily obtained a wiring material with a connector in which the connecting terminals are inserted into the common connector housing in such a manner that they are arranged at the above-mentioned arrangement pitch.

By the way, since the respective terminal fixing portions are smaller in width than the main body portions of the conductors, especially in the case of a high voltage, there is a fear that heat can be generated locally in the respective terminal fixing portions. However, in case where there is employed a structure in which a plurality of conductors are superimposed on top of one another in the end portions of the flat cables including the terminal fixing portions, although the terminal fixing portions are set small in width, the terminal fixing portions are allowed to secure section areas substantially equivalent to the main body portions of the conductors, which can prevent the above-mentioned local heat generation in the respective terminal fixing portions.

Also, according to a second aspect of the invention, there is provided a method for manufacturing a wiring material with a connector structured such that a common connector is disposed in the end portions of a plurality of flat cables, the method comprising the steps of: forming, in the end portions of the respective conductors of the flat cables, terminal fixing portions smaller in width than the main body portions of the respective conductors; superimposing the plurality of flat cables on top of one another in such a manner that the terminal fixing portions thereof are shifted in position from one another and are thereby arranged at a given pitch; and, inserting and fixing the connecting terminals to a common connector housing in such a manner that the connecting terminals are arranged at the above-mentioned pitch.

According to the present method, with use of a simple arrangement in which the flat cables with the terminal fixing portions formed therein (that is, the flat cables that do not require irregular shapes specially) are simply superimposed on top of one another, the terminal fixing portions can be arranged at a given terminal arrangement pitch, and the connecting terminals fixed to the present terminal fixing portions, as they are, can be inserted into a common connector housing with no inconvenience.

Here, the step of superimposing the plurality of flat cables on top of one another may be executed before the step of fixing the connecting terminals to their respective terminal fixing portions, and vice versa.

Also, the terminal fixing portion forming step may also comprise the steps of: removing an insulating material disposed on one-side outer surfaces of the end portions of the flat cables; forming, at least in part of the insulating material removed areas, small-width portions smaller in the conductor width than the remaining portions of the flat cable end portions; and, turning back the flat cables in the present small-width portions and superimposing the conductors on top of one another. In this case, there can be easily obtained terminal fixing portions in which a plurality of conductors are superimposed on top of one another, that is, terminal fixing portions which are formed small in width but are able to secure sufficient section areas.

Another aspect of the invention is a wiring material, comprising: a first flat cable including a plurality of rectangular conductors arranged in the width direction thereof at a given pitch, the outer peripheries of the rectangular conductors being covered with an insulating body; a second flat cable including one or two rectangular conductors, the outer peripheries of the rectangular conductors being covered with an insulating body, the second flat cable being superimposed on the first flat cable in such a manner that the rectangular conductor(s) of the second flat cable is (or are) superimposed on top of any one of the rectangular conductors of the first flat cable in the width direction thereof, wherein the end portions of the rectangular conductors of the mutually superimposed first and second flat cables are connected to a common terminal.

According to the present structure, since the first and second flat cables are connected to the common terminal in such a manner that the conductors of the first and second flat cables are superimposed on top of one each other, there can be obtained the current capacity that is required by a circuit to which the terminal is to be connected, without increasing the width dimensions of the flat cables. On the other hand, because it is not necessary to fix the middle portions of the first and second flat cables to each other and thus the first and second flat cables can maintain their states that they can be flexed and deformed independently of each other, differently from a structure in which the thickness of the conductors is increased, there is no fear that the flexibility of the whole wiring material can be degraded. Also, since the respective rectangular conductors are arranged at a given pitch, they can be fitted with an existing connector.

Also, according to another aspect of the invention, a plurality of second flat cables are superimposed on top of at least one of the rectangular conductors of the first flat cable. According to this structure, by superimposing a plurality of rectangular conductors of the second flat cable on top of the rectangular conductors of the first flat cable, there can be obtained the current capacity that is required by a circuit to which the terminal is to be connected.

Further, according to another aspect of the invention, the second flat cables include a flat cable structured such that a plurality of rectangular conductors are arranged in the width direction thereof at the same pitch as the pitch of the first flat cable. According to this structure, since the pitch of the rectangular conductors of the first flat cable is set equal to the pitch of the rectangular conductors of the second flat cable, although the second flat cable includes a plurality of conductors, the respective conductors can be superimposed on top of the rectangular conductors of the first flat cable. Also, because the second flat cable includes a plurality of rectangular conductors, the number of the second flat cables can be reduced.

And, according to another aspect of the invention, each of the second flat cables includes a single rectangular conductor and a required number of second flat cables are superimposed on top of the respective rectangular conductors of the first flat cable. According to this structure, as the second flat cable, flat cables having the same structure can be mass produced and the required number of flat cables may be used according to the required current capacity, which can enhance the productivity of the second flat cable.

Also, according to another aspect of the invention, the terminal is a pressure mounting terminal including embracing pieces, and the pressure mounting terminal is pressure mounted on the mutually superimposed rectangular conductors in such a manner that the embracing pieces embrace the end portions of the superimposed rectangular conductors. According to this structure, using a simple structure in which the end portions of the conductors of the first and second flat cables are embraced by the embracing pieces of the pressure mounting terminal, the end portions of the conductors can be connected to the terminal as an integral unit. Also, there is no need to remove the insulating bodies for covering the end portions of the conductors, which can enhance the productivity of the flat cables.

According to another aspect of the invention, in a wiring material as set forth in any one of the first to fourth aspects of the invention, the insulating bodies disposed on the end portions of the respective flat cables for covering the same are removed therefrom to thereby expose the end portions of the rectangular conductors of the flat cables, the superimposed rectangular conductors are superimposed on top of connecting portions formed in the terminal, and, in this superimposed state, they are connected together as a unit. According to this structure, since the connecting portion of the terminal is welded and connected to the exposed rectangular conductors of the first and second flat cables, strong connection can be realized between the terminal and flat cables.

DETAILED DESCRIPTION OF THE PREFERRED EMBODIMENTS

The First Preferred Embodiment

Now description will be given below of a first preferred embodiment of a method for manufacturing a wiring material according to the invention in the order of the steps of the method with reference to FIGS. 1 to 6.

Figure 1:
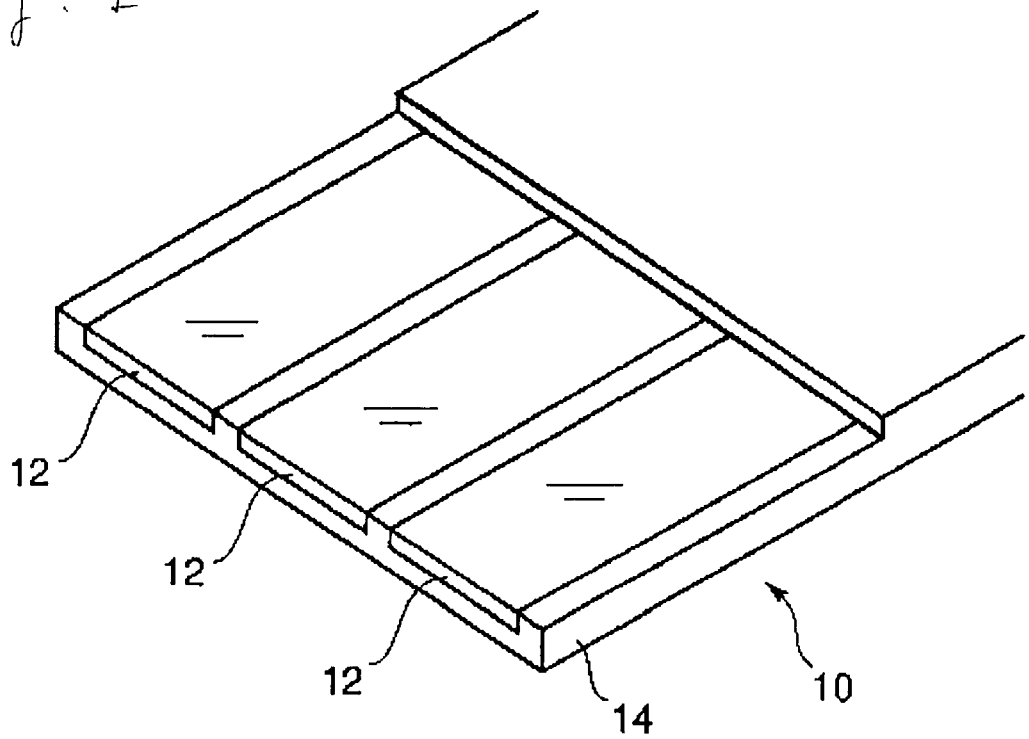
FIG. 1 is a perspective view of a first embodiment of a wiring material according to the invention, showing the step of removing the insulating material of a flat cable.

1) Insulating Material Removing Step (FIG. 1)

A flat cable 10 shown in FIG. 1 is structured such that a plurality of flat rectangular conductors 12 are arranged in the width direction thereof and the outer surfaces of the conductors 12 are covered by an insulating material 14. In the end portion of the flat cable 10, as shown in FIG. 1, the insulating material 14 disposed on one side of the conductor outer surfaces is removed to thereby expose one-side outer surfaces of the terminal end portions of the respective conductors 12 to the outside.

Figure 2:
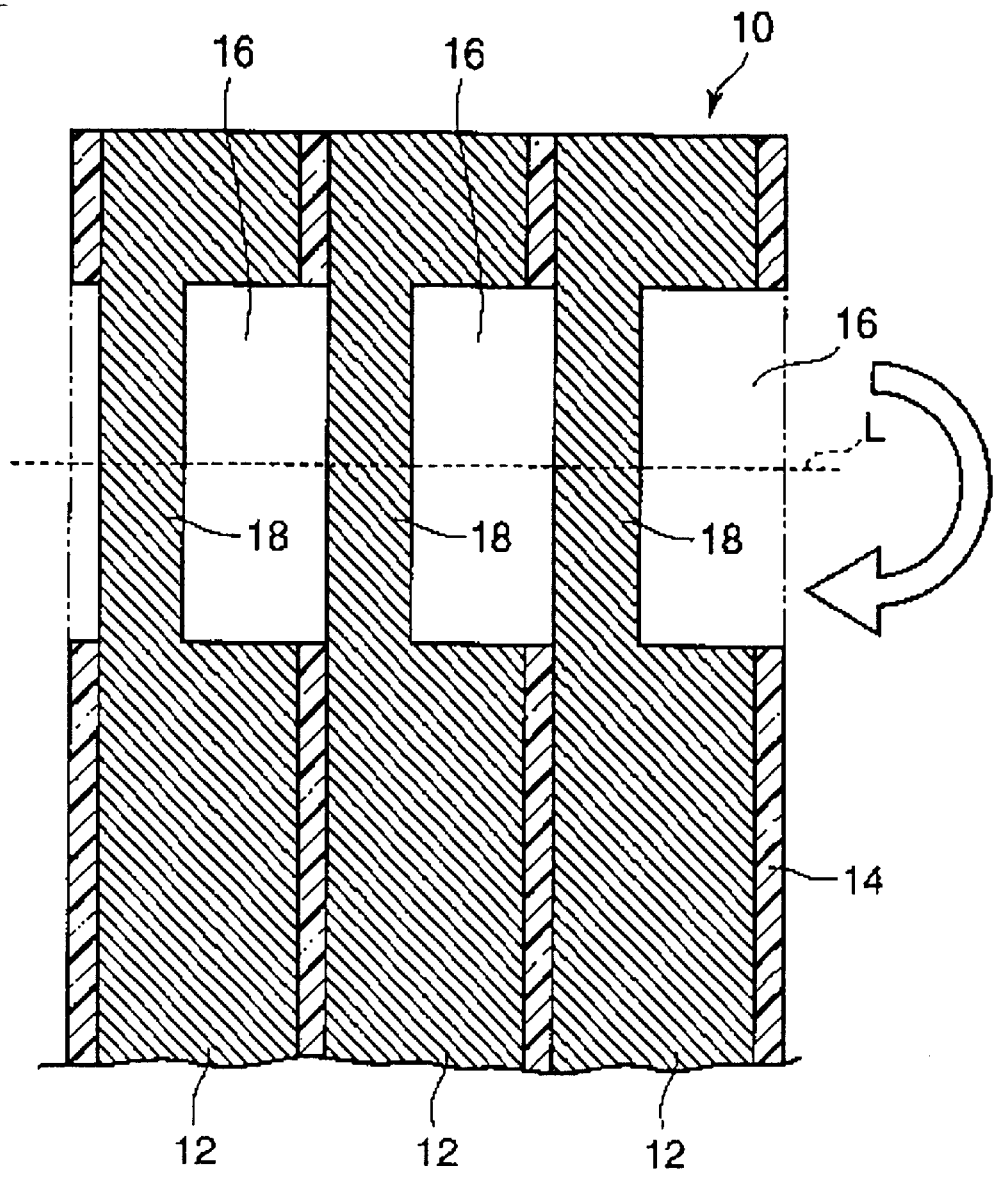
FIG. 2 is a sectional plan view of the first embodiment, showing the blanking step (small-width portion forming step).

2) Blanking Step (FIG. 2)

In the area of the flat cable 10 where the insulating material 14 has been removed in the insulating material removing step, while the leading end portions of the respective conductors 12 are left unblanked, about half areas of the width-direction one-side portions of the respective conductors 12, which exist in the rear of the leading end portions of the conductors 12, are blanked respectively using a pressing machine to thereby form rectangular-shaped hollow portions 16. The unblanked portions in the blanking operation not only connect together the portions that are situated on the leading end side of the flat cable 10 and are situated in the rear of the unblanked portions, but also form small-width portions 18 which are smaller in width than the-thus-connected front and rear portions of the flat cable 10.

3) Folding-Back Step (FIGS. 2 and 3)

Figure 3A:
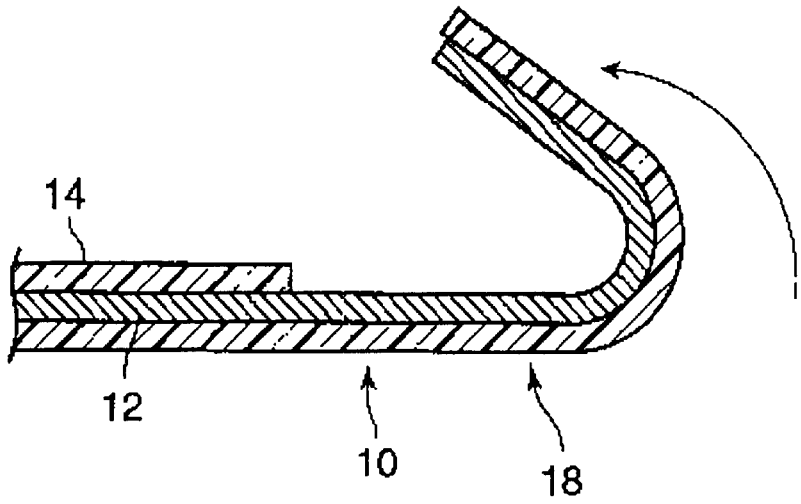
FIGS. 3A and 3B are respectively sectional front views of the first embodiment, showing the small-width portion folding step.
Figure 3B:
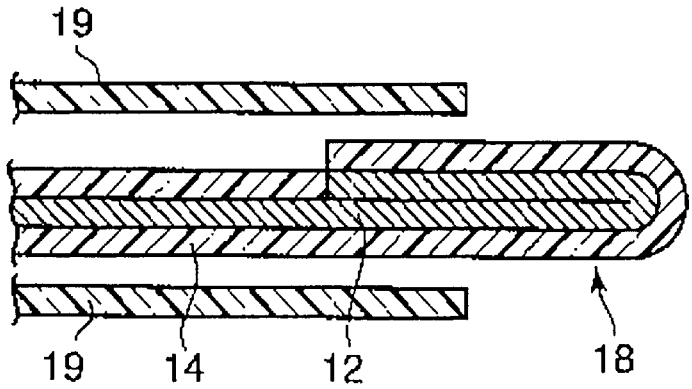

The longitudinal-direction middle portions of the respective small-width portions 18 are folded back with their conductor exposure-side surfaces facing inside. That is, the respective small-width portions 18 are turned back in a valley manner at a broken line L shown in FIG. 2 (FIG. 3A). This provides a small-width terminal fixing portions in which two conductors 12 are superimposed on top of each other. By the way, more preferably, an insulating film 19 shown in FIG. 3B may be bonded to the outer surfaces of the turned-back end portions to thereby cover the turned-back end portions of the small-width portions 18.

Due to this folding-back step, the terminal fixing portions composed of the small-width portions are arranged at regular intervals in the width direction thereof and, in this case, the formation positions of the small-width portions 18 are set such that the regular interval is two times a previously set terminal arrangement pitch a.

Figure 4A:
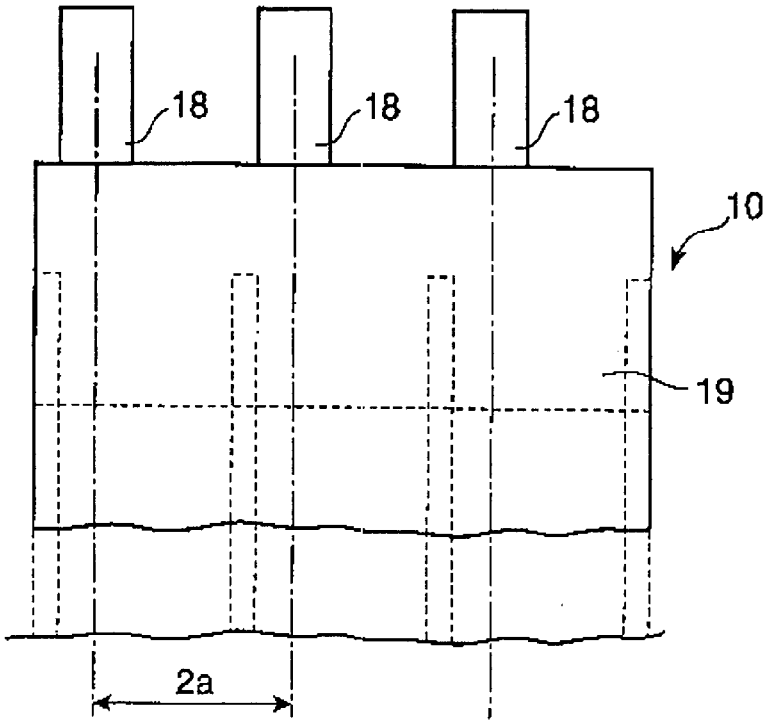
FIGS. 4A and 4B are respectively plan views of flat cables to be superimposed on top of each other in the superimposing step of the first embodiment.
Figure 4B:
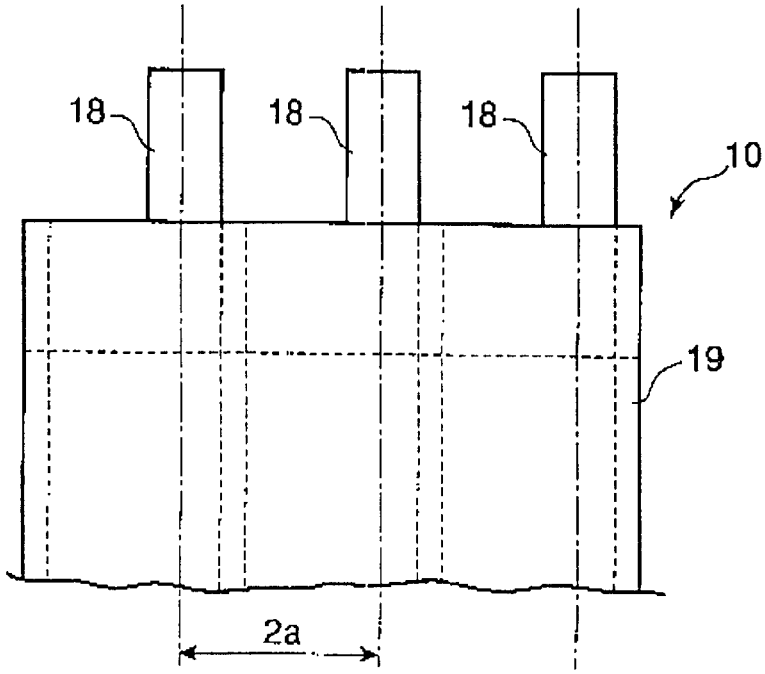
Figure 5:
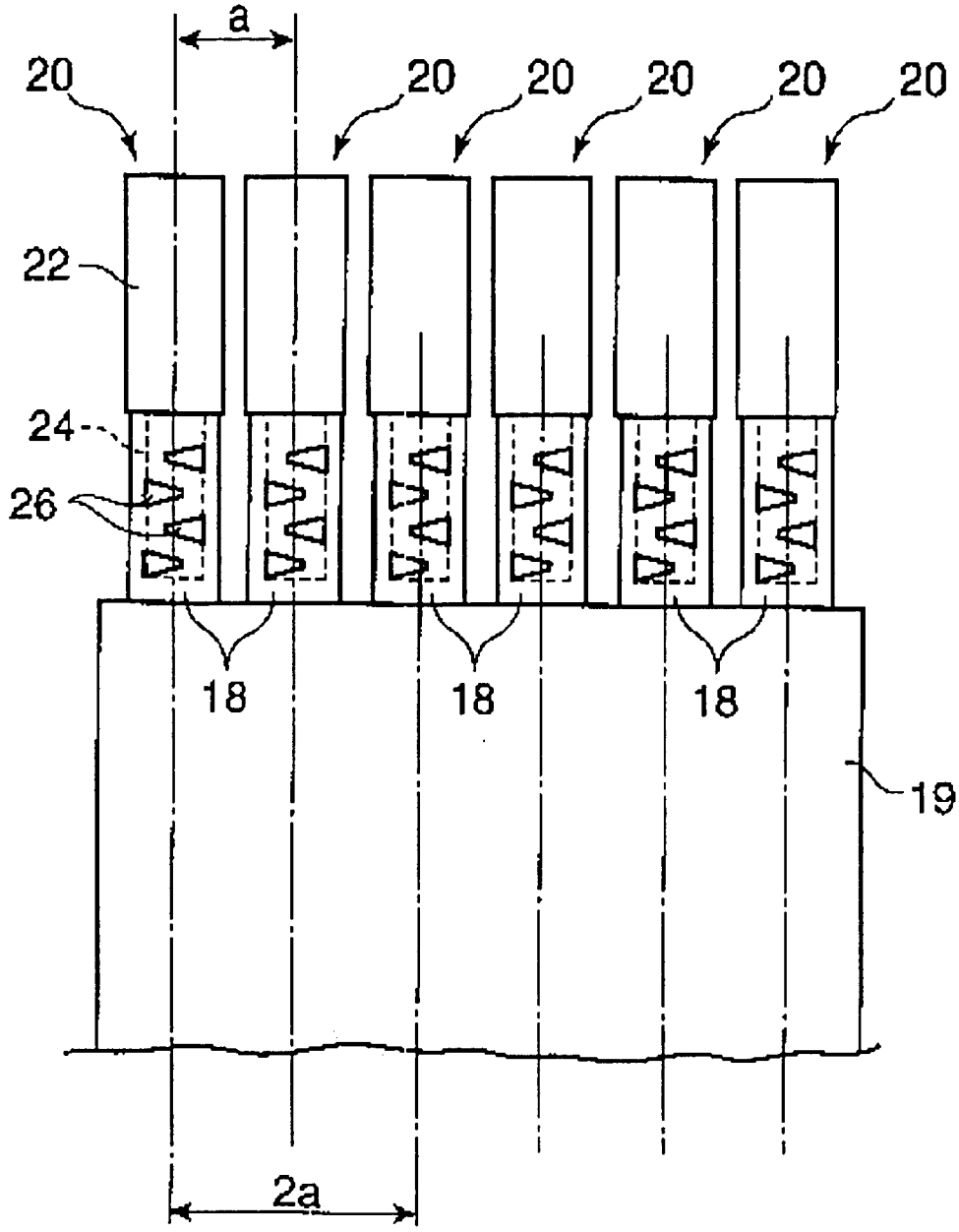
FIG. 5 is a plan view of the first embodiment, showing a state in which two flat cables are superimposed on top of each other in the superimposing step and connecting terminals are fixed to the terminal fixing portions of the flat cables.

4) Superimposing Step & Terminal Pressure Mounting Step (FIGS. 4 and 5)

Two flat cables 10, which have been manufactured according to the steps 1)-3), are superimposed on each other in such a manner that, as shown in FIGS. 4(*a*) and (*b*), they face each other with the front and back surfaces thereof reversed (that is, the width-direction positions of the small-width portions 18 are shifted from each other by the terminal arrangement pitch a). Due to this, as shown in FIG. 5, there can be obtained a wiring material in which the small-width portions 18 are arranged at regular intervals in the width direction thereof at the same pitch as the terminal arrangement pitch a. And, connecting terminals 20 are then fixed to the thus arranged terminal fixing portions, respectively.

In the illustrated embodiment, as the connecting terminals 20, there are used pressure mounting terminals. That is, each of the terminals 20 is structured such that an electric connecting portion 22 to be fitted with its mating terminal is formed integral with a pressure mounting portion 24 extending backwardly of the electric connecting portion 22, and a plurality of pressure mounting pawls 26 are provided on and projected from the pressure mounting portion 24. In operation, the pressure mounting pawls 26 are inserted into the respective small-width portions 18 from bottom and are deformed so as to embrace the conductors 12 existing within the small-width portions 18, thereby being able to fix and electrically connect the connecting terminals 20 to the small-width portions 18. The thus pressure mounted connecting terminals 20, inevitably, are also arranged at the above-mentioned pitch a in the width direction thereof.

By the way, the terminal pressure mounting step and the flat cable 10 superimposing step may also be reversed in order. That is, the connecting terminals 20 may be firstly pressure mounted and, after then, the flat cables 10 may be then superimposed on top of each other.

Figure 6:
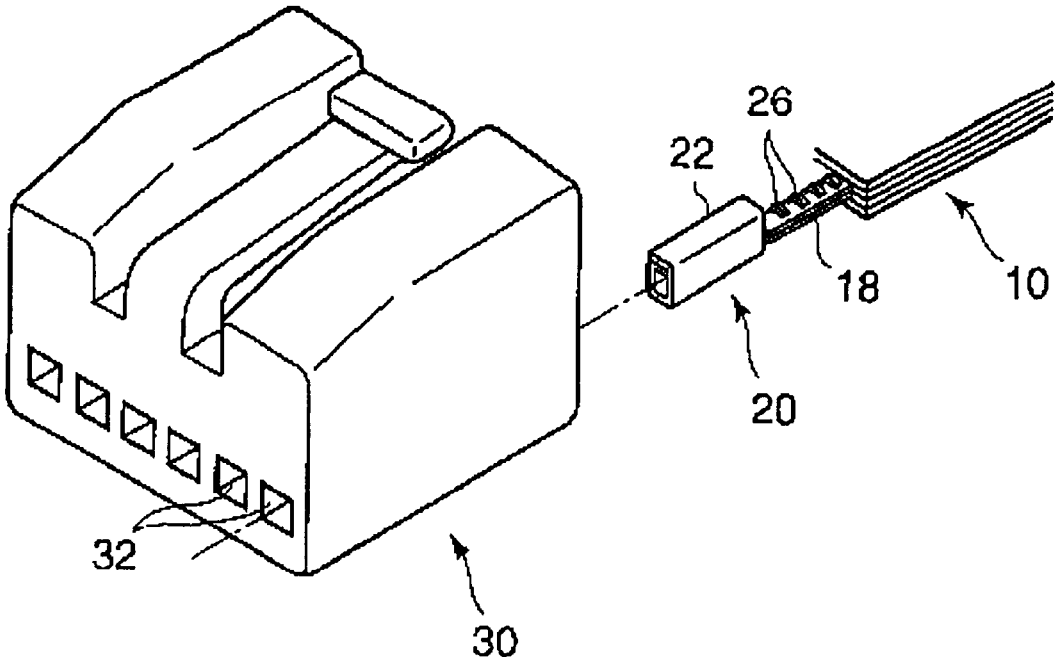
FIG. 6 is a perspective view of the first embodiment, showing the step of inserting and fixing the connecting terminals to a common connector housing.

5) Connector Mounting Step (FIG. 6)

The two connecting terminals 20 arranged at the pitch a in the above-mentioned manner are respectively inserted into and fixed to their associated terminal storage chambers (partition chambers respectively formed in the rear of their associated windows 32 shown in FIG. 6) formed in a common connector housing 30 shown in FIG. 6. These terminal storage chambers are arranged in the interior of the connector housing 30 at the same pitch as the terminal arrangement pitch a. Therefore, while the two flat cables 10 are superimposed on top of each other in the above-mentioned manner, the respective connecting terminals 20, as they are, can be inserted into and fixed to their associated terminal storage chambers with no inconvenience.

By the way, there is no limit to a concrete structure for fixing the respective terminals to the interior of the connecting housing 30, but there can also be applied the internal structures of conventionally known various connectors as they are.¶

According to the thus manufactured wiring material, with use of a simple structure in which, while expanding the respective conductors 12 greatly more than the widths of the terminals to thereby increase the current capacity of the conductors, the two flat cables 10 are simply superimposed on top of each other, the arrangement pitch of the terminal fixing portions (small-width portions 18) formed in the end portions of the respective conductors 12 can be matched to a given terminal arrangement pitch. Therefore, a wiring material with a connector can be manufactured easily while not only increasing the current capacity of the respective conductors but also preventing the mass productivity and yield rate thereof from being lowered.

Further, in the present embodiment, since the terminal fixing portions are formed by turning back the small-width portions 18 and then superimposing the conductors 12 on top of each other, even in case where the terminal fixing portions are small in width, there can be secured a cross section area substantially equivalent to the main body portion of the conductor 12. Therefore, even in case where a voltage used is relatively high, there can be prevented an inconvenience that heat can be generated in the small-width terminal fixing portions.

Figure 7A:
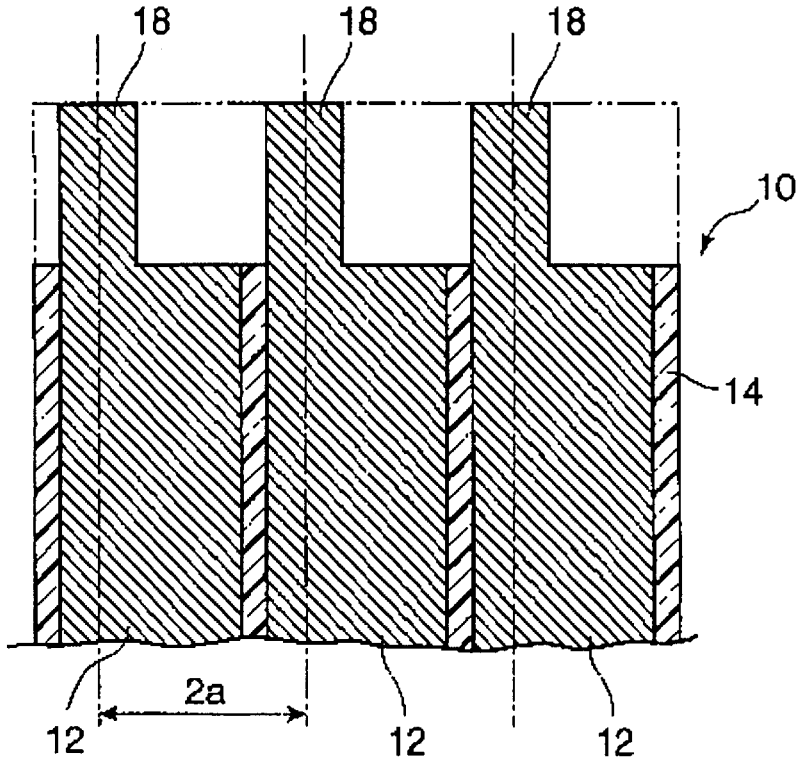
FIGS. 7A and 7B are respectively sectional plan views of flat cables according to a second embodiment of the invention.
Figure 7B:
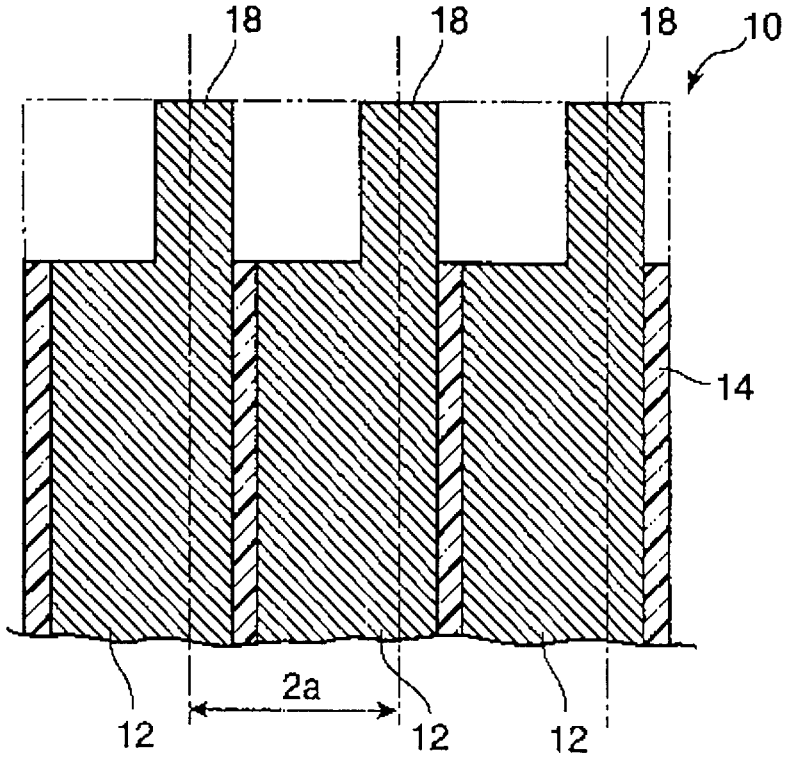
Figure 8:
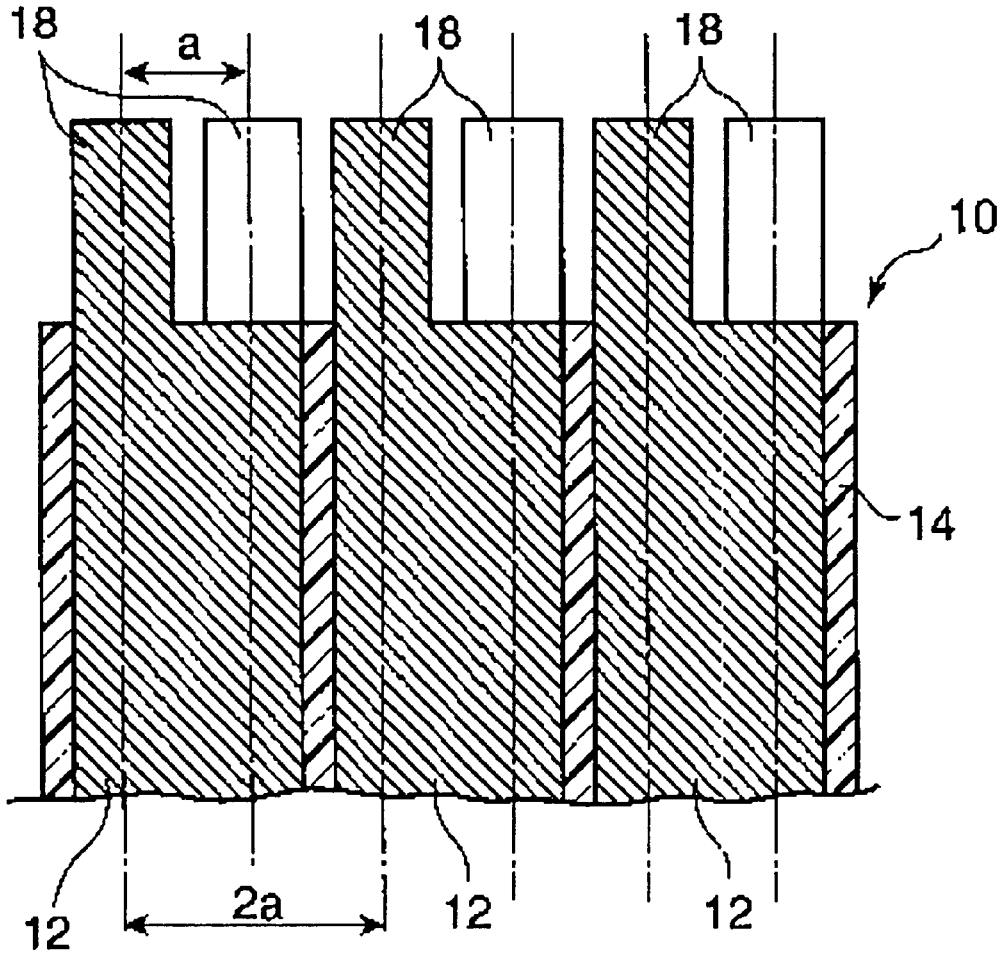
FIG. 8 is a sectional plan view of a wiring material in which the flat cables shown in FIGS. 7A and 7B are superimposed on top of each other.

Of course, in case where there is no fear that such heat generation can occur, or in case where such heat generation is slight and can be neglected, a plurality of conductors must not be always superimposed on top of each other in the terminal fixing portions thereof. For example, as shown in FIGS. 7 and 8, a single piece of small-width portion 18, which is provided on each of the conductors 12 and projected therefrom toward the leading end side thereof, may be as it is arranged so as to form a terminal fixing portion. That is, the connecting terminals may be fixed directly to the thus formed small-width portions 18. Also, as the connecting means for connecting together the connecting terminals and their respective terminal fixing portions, use of the above-mentioned pressure mounting means is not limitative but there can also be employed other connecting methods such as welding.

Figure 9A:
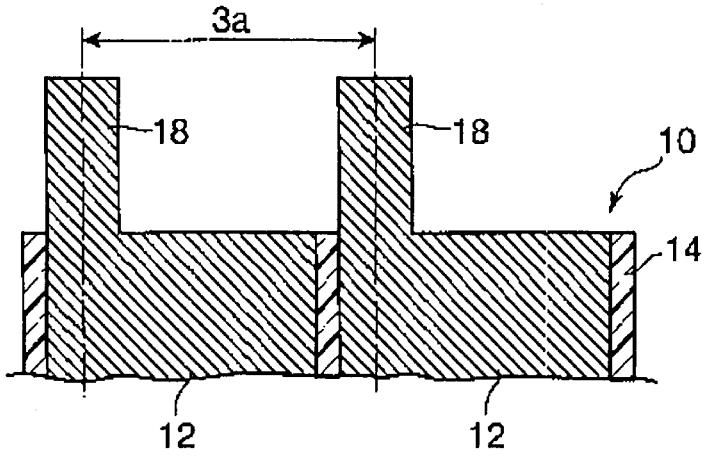
FIGS. 9A, 9B, and 9*c* are respectively sectional plan views of the terminal end structures of flat cables to be superimposed on top of one another.
Figure 9B:
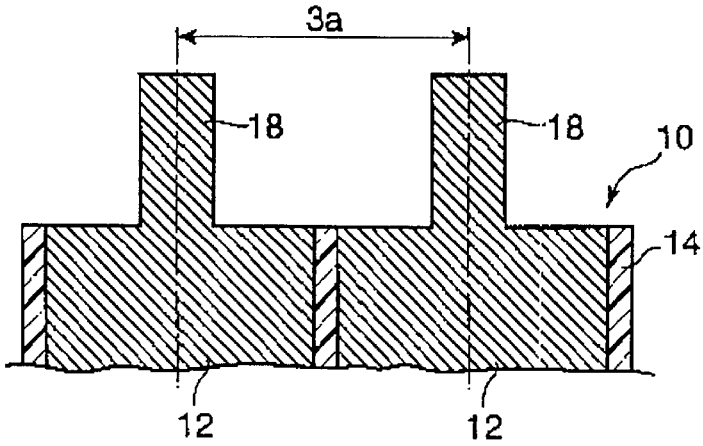
Figure 9C:
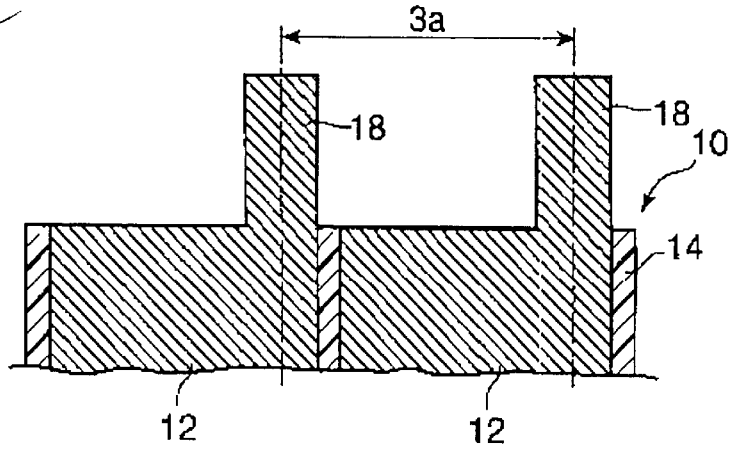

Further, according to the invention, by increasing the number of flat cables 10 to be superimposed together, the widths of the main body portions of the conductors 12 can be expanded more than the small-width portions 18. For example, as shown in FIG. 9, there are employed three flat cables 10 respectively structured such that small-width portions 18 are formed respectively in the left side, central side and right side of the terminal end portions of the conductors 12 of the flat cables 10, and an interval between the small-width portions 18 is set three times the arrangement pitch a of the terminals; and, the thus structured three flat cables 10 are then superimposed on top of one another. That is, in this case, while expanding the width of the conductor main portions up to about three times the width of the small-width portions 18, the arrangement pitch of the terminal end portions of the respective conductors 12 can be matched to the arrangement pitch a of the terminals.¶

As has been described heretofore, according to the wiring material of the invention, two or more flat cables each including in the terminal end portions of the respective conductors thereof the terminal fixing portions smaller in width than the main body portions of the conductors are superimposed on top of each other, so that the respective terminal fixing portions of the conductors can be arranged at a given terminal arrangement pitch. Due to this, the present invention can provide the following effects: that is, while not only expanding the widths of the main body portions of the respective conductors to thereby increase the current capacity of the respective conductors but also preventing the mass productivity and yield rate thereof from being lowered, the terminal end portions of the respective conductors can be matched to the terminals to be connected to the conductors.

The Second Preferred Embodiment

Figure 10A:
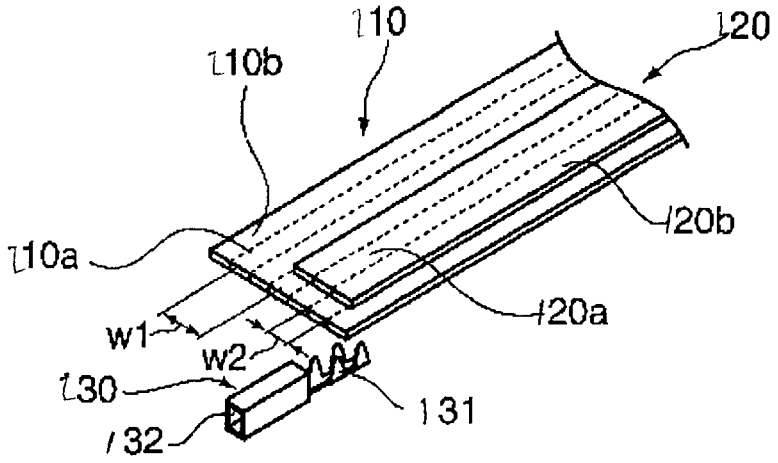
FIGS. 10A, 10B and 10C show a method for manufacturing a first embodiment of a wiring material using a single first flat cable and a single second cable according to the invention.
Figure 10B:
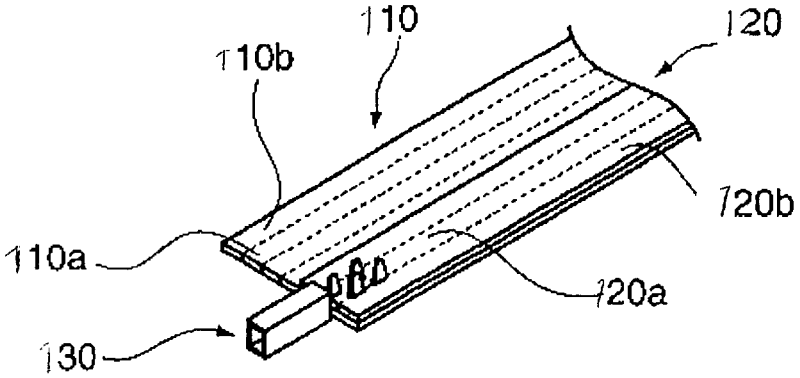
Figure 10C:
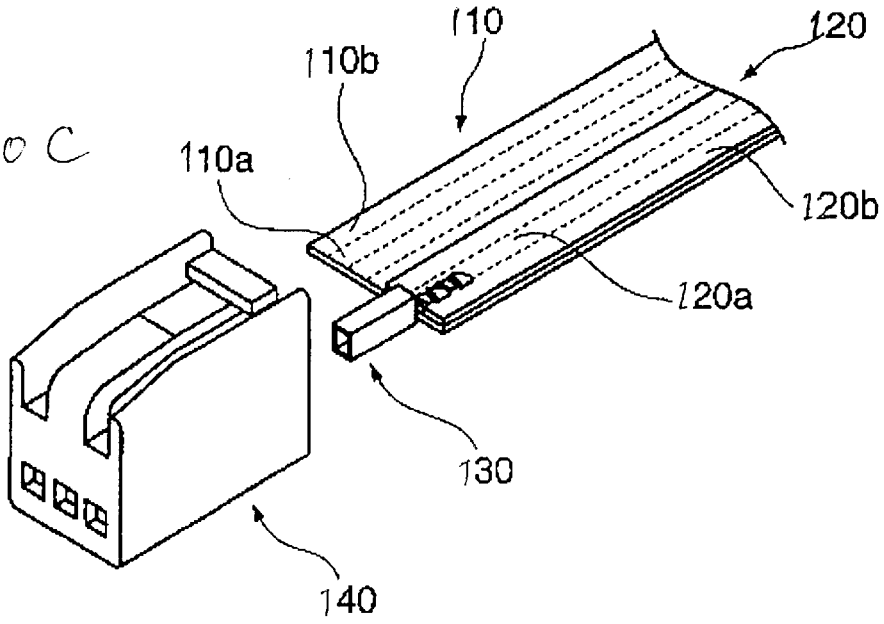

Now, FIGS. 10A, 10B and 10C show a method for manufacturing an embodiment of a wiring material composed of a single first flat cable and a single second flat cable according to the invention.

According to the present wiring material manufacturing method, as shown in FIG. 10A, firstly, there are prepared first and second cables 110 and 120. In the case of the first flat cable 110, three rectangular conductors each having a width w2 are arranged parallel to one another at a pitch w1, and the outer periphery of the first flat cable 110 is covered with an insulating body 110*b* in a flat-plate shape. Also, in the case of the second flat cable 120, a single rectangular conductor 120*a* having a width w2 is covered with an insulating body 120*b* in a flat-plate shape.

Next, with the end portions of the first and second flat cables 110 and 120 arranged uniformly, the first and second flat cables 110 and 120 are piled on each other in such a manner that the rectangular conductors 110*a* and 120*a* are superimposed on top of each other.

Then, such a pressure mounting terminal 130 as shown in FIG. 10B is fixed to the mutually superimposed conductor end portions. The pressure mounting terminal 130 is composed of a prism-shaped fitting portion 132 to be fitted with the cavity of a connector and four embracing pieces 131, 131, 131, 131 which are extended from the fitting portion 132 and are disposed so as to embrace the rectangular conductors.

To fix such pressure mounting terminal 130 to the conductor end portion, firstly, as shown in FIG. 10B, the embracing pieces 131 are stuck into the flat cable 120 through their respective sharp leading edges so that they are penetrated through the flat cable 120. Next, as shown in FIG. 10C, the embracing pieces 131, which are opposed to each other with the rectangular conductors penetrated by the embracing pieces between them, are bent in their mutually facing directions to thereby fix the first and second flat cables 110 and 120 to each other.

Figure 11:
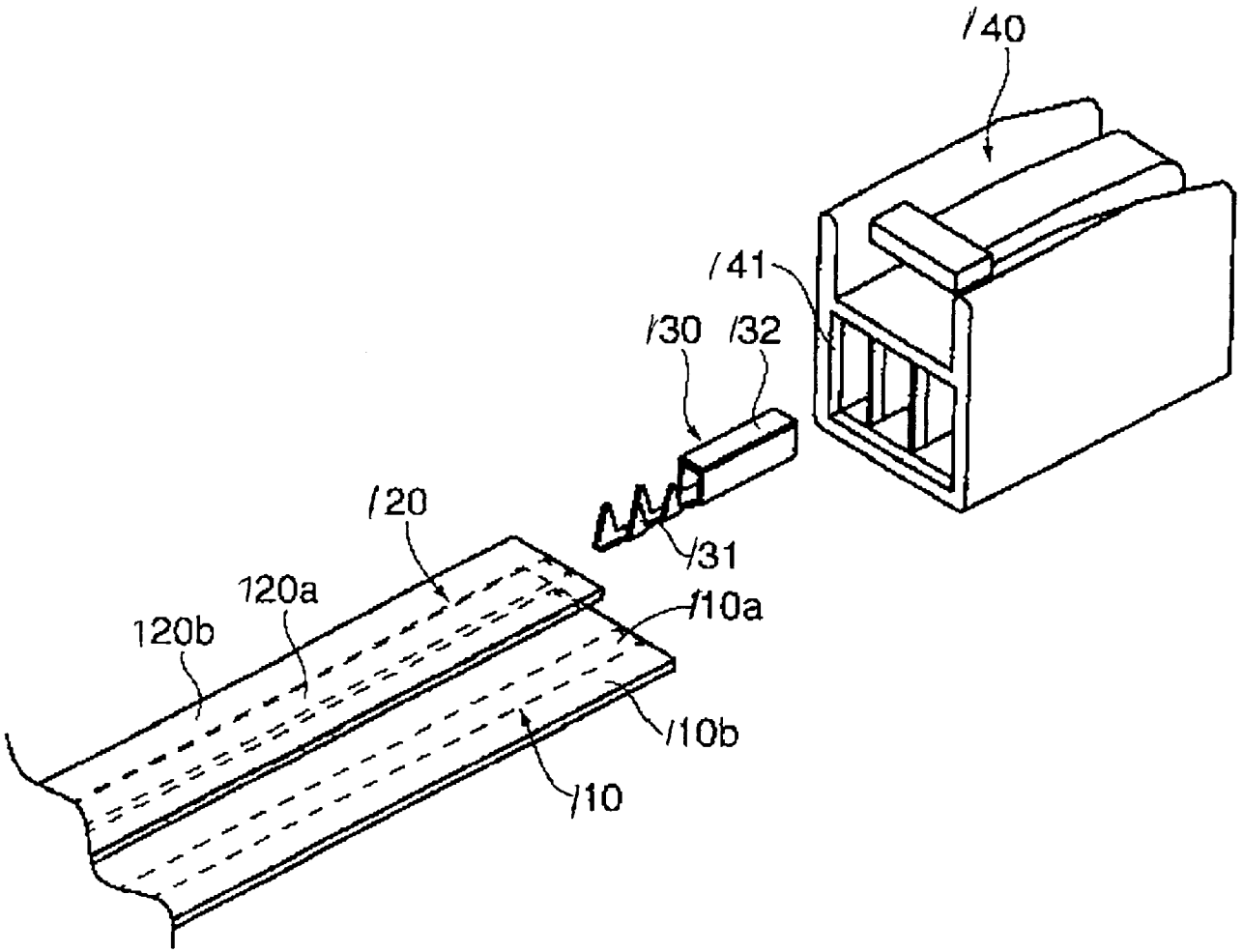
FIG. 11 is a perspective view of the whole of flat cables, a terminal and a connector, when they are viewed from the cavity side of the connector.

Now, FIG. 11 is a general view of the first and second flat cables 110, 120, terminal 130, and connector 140, when they are viewed from the cavity side 141 of the connector 140. In the terminal 140, there are formed three cavities 141 in the width direction of the terminal 140 at the same pitch as the pitch w1 of the rectangular conductor 120. Through the steps shown in FIGS. 10A–10C, the fitting portion 132 of the terminal 130 with the first and second flat cables 110, 120 connected thereto is fitted into the cavity 141 of the connector 140, so that the flat cables 110, 120 and connector 140 are connected together. By the way, although not shown in FIG. 11, two other terminals 130 are respectively connected to the two remaining rectangular conductors 110*a* of the first flat cable 110 in which the first and second flat cable 110 and 120 are not superimposed on top of each other and, after then, the fitting portions 132 of the present terminals 130 are fitted into their respective cavities 141 of the connector 140.

Figure 12:
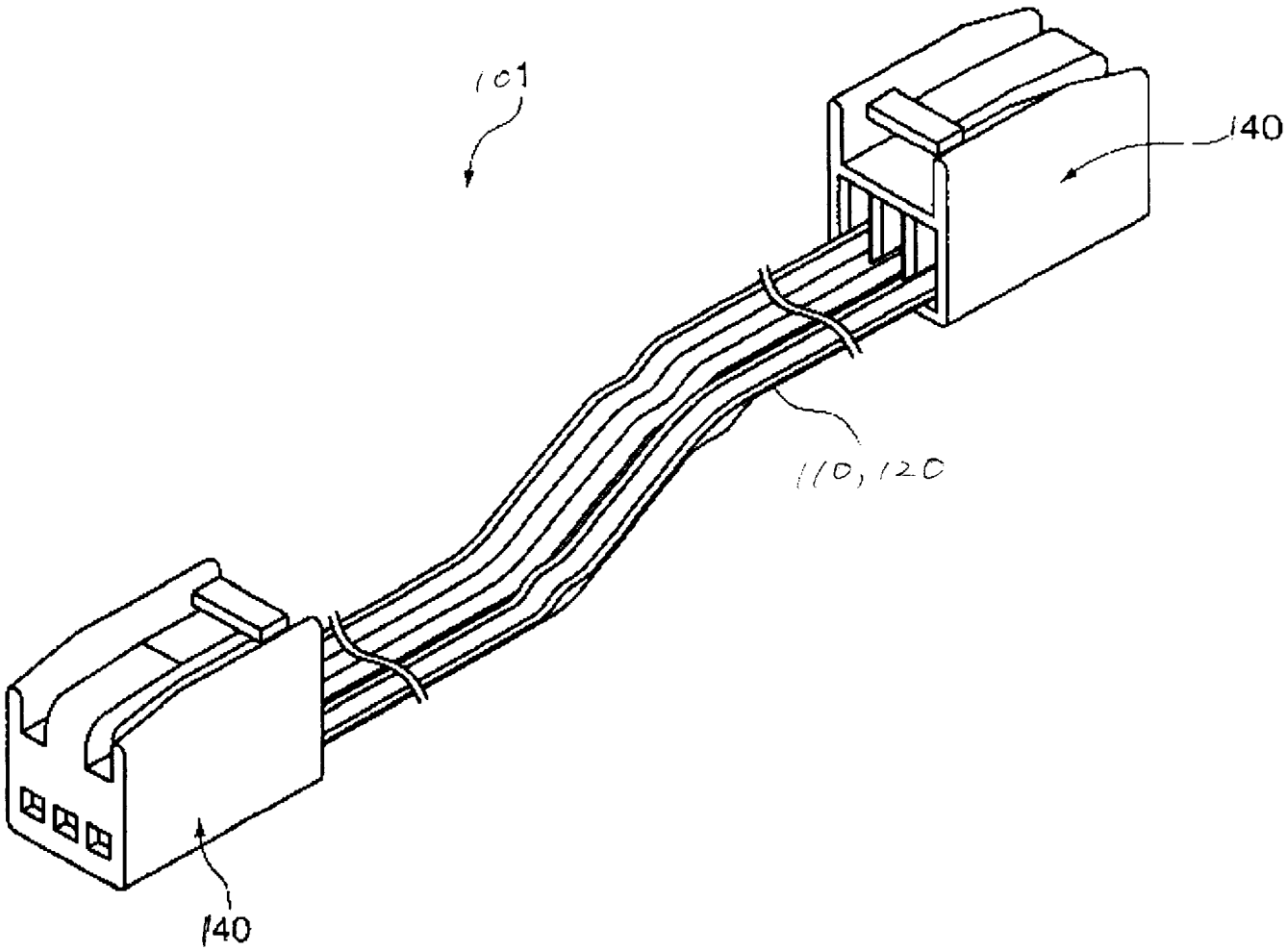
FIG. 12 is a perspective view of the whole of a wiring material with connectors connected to the two end portions thereof.

Now, FIG. 12 is a general view of the whole of the wiring material 101 which has been produced through the steps shown in FIGS. 10A–10C. This wiring material 101 is structured such that the connector 140 is connected to the respective two-end portions of the first and second flat cables 110 and 120 with their respective end portions processed. The first and second flat cables 110 and 120 are connected together in their two end portions by the terminals 130, while the middle portions of the first and second flat cables 110 and 120 are not connected to each other. Therefore, when compared with a wiring material in which the thickness of the flat cables is increased so as to secure the current capacity thereof, the present wiring material 101 can be easily flexed in the middle portions of the first and second flat cables 110 and 120.

Also, since the present wiring material 101 uses a flat cable including rectangular conductors arranged to the pitch of the cavities 141 of the connector 140, the connector 140 and first and second flat cables 110, 120 can be connected together at a pitch corresponding to the connector pitch.

Figure 13A:
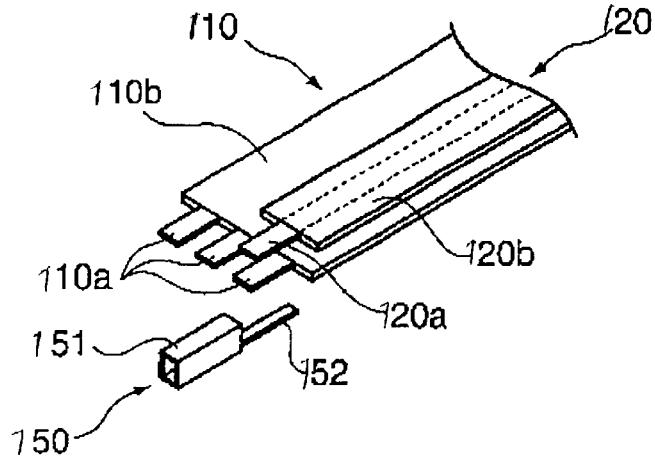
FIGS. 13A, 13B and 13C show the step of processing the end portion of a wiring material using a terminal different from a pressure mounting terminal.
Figure 13B:
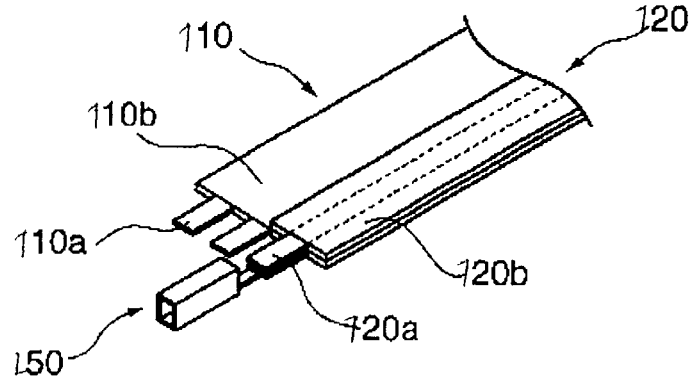
Figure 13C:
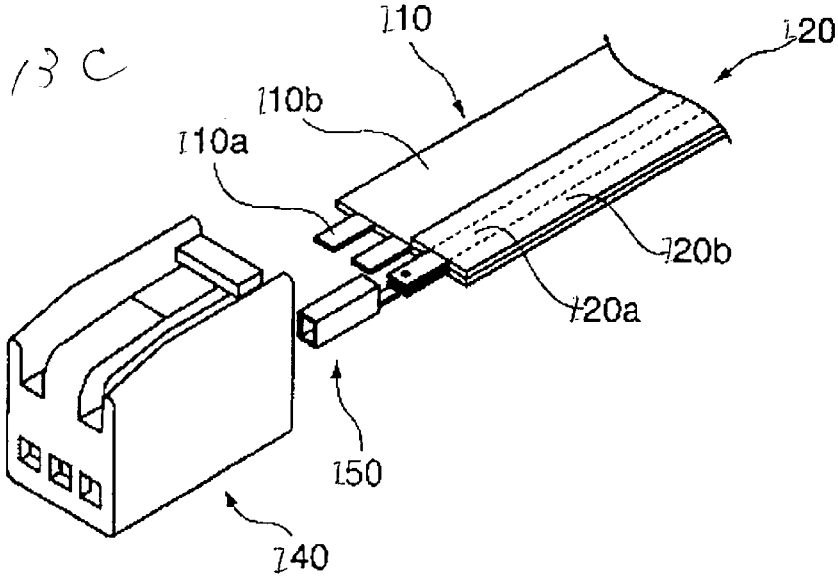

Now, FIGS. 13A–13C show a method for processing the end portions of flat cables when a wiring material is structured using a terminal different from the above-mentioned pressure mounting terminal. In this method, firstly, as shown in FIG. 13A, insulating bodies 110*b*, 120*b* disposed on the end portions of the first and second cables 110, 120 are removed therefrom in such a manner that the lengths of the insulating bodies in the longitudinal direction thereof are the same, so that the rectangular conductors 110*a* and 120*a* are exposed.

Next, as shown in FIG. 13B, the thus exposed rectangular conductors 110*a* and 120*a* are connected to a terminal 150. This terminal 150 is composed of a prism-shaped fitting portion 151 to be fitted into the cavity of a connector and a connecting portion 152 made of a flat-plate-shaped metal which is extended from the fitting portion 151.

Then, the superimposed rectangular conductors 110*a*, 120*a* are superimposed on top of the connecting portion 152 of the terminal 150 and, for example, by ultrasonic vibrations using an ultrasonic welding machine, the rectangular conductors 110*a*, 120*a* and connecting portion 152 are connected together as a unit.

After then, the terminal 150 of the welded flat cables is inserted into the cavity of the connector 140, which completes the wiring material 101.

As described above, in case where the insulating bodies 110*b*, 120*b* disposed on the end portions of the first and second cables 110, 120 are removed therefrom to thereby expose the rectangular conductors 110*a* and 120*a*, the flat-plate-shaped connecting portion 152 of the terminal 150 is superimposed on the exposed rectangular conductors 110*a* and 120*a*, and they are welded together, there can be realized strong connection between the insulating bodies 110*b*, 120*b* and terminal 150.

Figure 14:
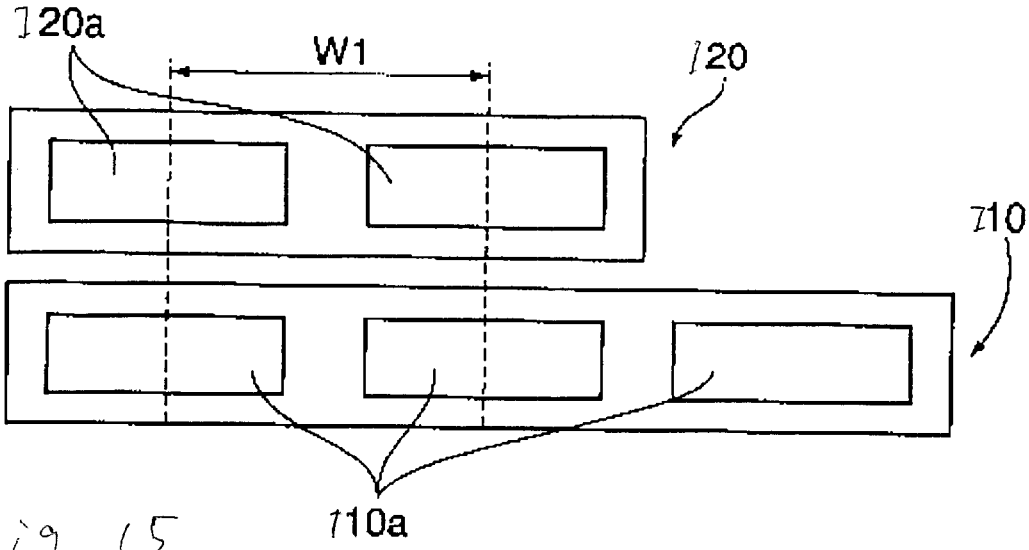
FIG. 14 is a view of a second embodiment of a wiring material including second flat cables in each of which two rectangular conductors are arranged in the width direction thereof.

Further, FIG. 14 is a view of another embodiment of a wiring material according to the invention; that is, the embodiment uses a second flat cable 120 including two rectangular conductors arranged in the width direction thereof. In the present wiring material using this second flat cable 120, as the second flat cable 120, there are arranged two rectangular conductors at the same pitch as the rectangular conductors 110*a* of a first flat cable 110. Since the rectangular conductors of the second flat cable are arranged at the same pitch as the rectangular conductors 110*a* of the first flat cable 110, although the second flat cable 120 includes the two rectangular conductors, the two rectangular conductors of the second flat cable 120 can be superimposed on top of the rectangular conductors 110*a* of the first flat cable 110. Also, use of the flat cable composed of two rectangular conductors can reduce the number of second flat cables.

Figure 15:
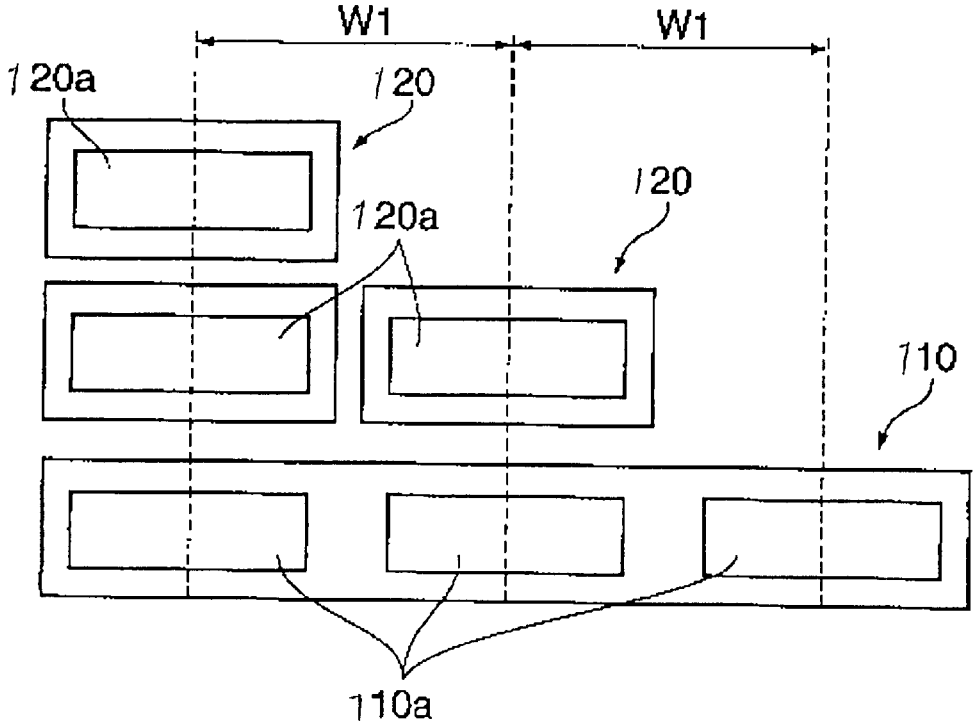
FIG. 15 is a view of a third embodiment of a wiring material including second flat cables each including only one rectangular conductor.
Figure 16:
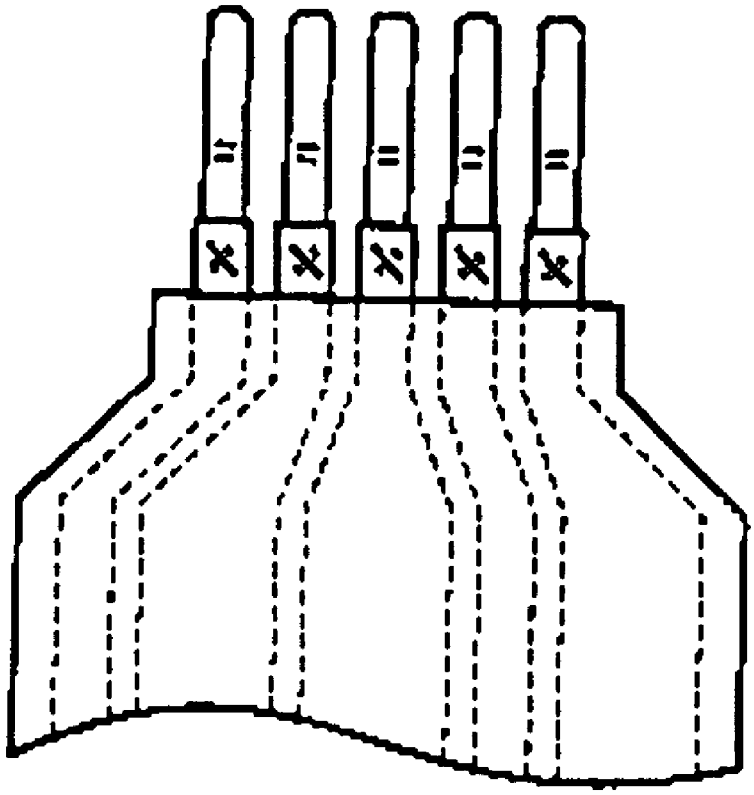
FIG. 16 is a view of a conventional wiring material.

On the other hand, FIG. 15 shows another embodiment of a wiring material according to the invention, which uses a plurality of second flat cables each including only one rectangular conductor. In the present wiring material, another second flat cable composed of a rectangular conductor is further superimposed on top of the wiring material according to the this embodiment in the thickness direction thereof; that is, a total of three flat cables are superimposed on top of one another in the thickness direction thereof. According to the present wiring material, in the portion thereof in which the three rectangular conductors are superimposed on top of one another, the three rectangular conductors can obtain current capacity three times the current capacity that is obtained in the case of a single rectangular conductor; and, in the portion thereof in which the two rectangular conductors are superimposed on top of each other, the two rectangular conductors can obtain current capacity two times the current capacity that is obtained in the case of a single rectangular conductor. That is, the number of second flat cables 120 to be superimposed may be selected properly depending on the current capacity that is required. Also, in case where, as the second flat cable 120, there is used a flat cable composed of a single rectangular conductor and a plurality of such flat cables are combined together to thereby produce a wiring material, the mass productivity of the second flat cables 120 can be enhanced.

By the way, there may also be employed a structure different from the structures shown in FIGS. 10 to 15, in which second flat cables 120 are superimposed on the front and back surfaces of the first flat cable 110.

In the illustrated embodiments, the first flat cable 110 is composed of three rectangular conductors. However, the present invention is not limited to this but, for example, the first flat cable 110 may also be formed of one or two rectangular conductors, or four or more rectangular conductors. Also, in the case of the second flat cable 120, similarly, the number of rectangular conductors is not limited to one but two or more rectangular conductors may also be used.

According to the invention, the first and second flat cables are superimposed on top of each other in the thickness direction thereof, and the first and second flat cables are connected together using their common terminal. Thanks to this, without increasing the dimensions of the flat cables in the width direction thereof, there can be secured the current capacity that is required by a circuit to which the terminal is to be connected. On the other hand, it is not necessary to connect together the middle portions of the first and second flat cables and thus the first and second flat cables can be flexed and deformed independently of each other. Therefore, differently from a structure in which the conductors are increased in thickness, there is no fear that the flexibility of the whole wiring material can be degraded. Also, since the respective rectangular conductors are arranged at a given pitch, they can be fitted with an existing connector.

What is claimed is:

1. A wiring material comprising a plurality of flat cables, each of the flat cables including a plurality of conductors arranged in the width direction thereof and an insulating body for covering at least the outer surfaces of a main portion of the conductors;

wherein respective end portions of the conductors are formed smaller in width than the main body portions, wherein said plurality of flat cables are superimposed in the thickness direction thereof and are mutually shifted in the width direction thereof so that the end portions of the conductors are sequentially arranged by turns in the width direction, and wherein the end portions comprise small-width portions that are folded back so that the end portions have a greater thickness than a thickness of the main portion of the conductors.

2. The wiring material according to claim 1, wherein the end portions of the conductors are formed as terminal fixing portions to be connected to connecting terminals; and the terminal fixing portions are arranged at the same pitch as the arrangement pitch of the connecting terminals.

3. The wiring material according to claim 2, wherein the respective flat cables are equivalent to one another in the number of conductors and in the conductor arrangement pitch and, between the flat cables, formation positions of the terminal fixing portions of the conductors are shifted from one another in the width direction thereof by the connecting terminal arrangement pitch.

4. The wiring material according to claim 2, wherein the connecting terminals are respectively fixed to the fixing terminal portions, and the connecting terminals are inserted into a common connector housing.

5. The wiring material according to claim 1, wherein the end portions of conductors are superimposed in the thickness direction of the flat cables.

6. The wiring material according to claim 1, wherein the thickness of the end portions is about double the thickness of the conductors.

7. A method for manufacturing a wiring material comprising a plurality of flat cables, each of the flat cables including a plurality of conductors, end portions of the conductors being connected to a common connector, the method comprising the steps of:

forming, in the end portions of the conductors of the flat cables, terminal fixing portions smaller in width than main body portions of the conductors;

superimposing the plurality of flat cables on top of one another in such a manner that the terminal fixing portions thereof are shifted in position from one another and are thereby arranged at a given pitch;

inserting and fixing connecting terminals to a common connector housing in such a manner that said connecting terminals are arranged at said pitch;

removing an insulating material disposed on one-side outer surfaces of the end portions of said flat cables;

forming said small-width portions of the conductors, which are smaller in width than the remaining portions of the conductors of the flat cables at least in a part of the insulating material removed areas; and folding back the flat cables in said small-width portions and superimposing the conductors on top of one another.

8. A wiring material manufactured by the method of claim 7.

9. A wiring material, comprising:

a first flat cable including a plurality of rectangular conductors arranged in the width direction thereof at a given pitch, the outer peripheries of the rectangular conductors being covered with an insulating body, and a second flat cable including a plurality of rectangular conductors, the outer peripheries of the rectangular conductors being covered with an insulating body;

wherein the second flat cable is superimposed on the first flat cable in such a manner that at least one of the rectangular conductors of the second flat cable is superimposed on top of any one of the rectangular conductors of the first flat cable in the thickness direction thereof, wherein end portions of mutually superimposed rectangular conductors of the first and second flat cables are connected to a common terminal, and wherein the end portions comprise small-width portions that are folded back so that the end portions have a greater thickness than a thickness of the main portion of the conductors.

10. The wiring material according to claim 9, wherein a plurality of the second flat cables are superimposed on top of at least one of the rectangular conductors of the first flat cable.

11. The wiring material according to claim 10, wherein each of the second flat cables includes a single rectangular conductor, and each of the rectangular conductors of the second flat cable is superimposed on each of the rectangular conductors of the first flat cable.

12. The wiring material according to claim 9, wherein the second flat cable includes a flat cable structured such that at least some of the rectangular conductors are arranged in the width direction thereof at the same pitch as the pitch of at least some of the rectangular conductors of the first flat cable.

13. The wiring material according to claims 9, wherein the terminal is a pressure mounting terminal including embracing pieces pressure; and the pressure mounting terminal is mounted on the mutually superimposed rectangular conductors to embrace the end portions of the superimposed rectangular conductors.

14. The wiring material according to claim 9, wherein insulating bodies on the end portions of the flat cables are removed therefrom to expose the end portions of the rectangular conductors; and the mutually superimposed end portions of the rectangular conductors are welded to the terminal to be connected thereto.

15. The wiring material according to claim 9, wherein the thickness of the end portions is about double a thickness of the main portion of the conductors.

* * * * *